United States Patent [19]

Ehemann

[11] 4,346,826

[45] Aug. 31, 1982

[54] APPARATUS AND METHOD FOR USE IN FINISH PRESSING

[75] Inventor: Gero Ehemann, Ippener, Fed. Rep. of Germany

[73] Assignee: Kurt Ehemann Spezialmaschinenfabrik KG, Delmenhorst, Fed. Rep. of Germany

[21] Appl. No.: 166,758

[22] Filed: Jul. 7, 1980

[30] Foreign Application Priority Data

| | | | |
|---|---|---|---|
| Jul. 18, 1979 | [DE] | Fed. Rep. of Germany | 2929057 |
| Jul. 27, 1979 | [DE] | Fed. Rep. of Germany | 2930622 |
| Oct. 26, 1979 | [DE] | Fed. Rep. of Germany | 2943420 |

[51] Int. Cl.[3] ..... D06F 71/18; D06F 71/40

[52] U.S. Cl. ..... 223/70; 38/14; 38/144

[58] Field of Search ..... 223/68, 69, 70, 71, 223/72, 73, 74; 38/14, 144

[56] References Cited

U.S. PATENT DOCUMENTS

| | | | |
|---|---|---|---|
| 2,088,513 | 7/1937 | Gilbert | 223/68 |
| 2,157,822 | 5/1939 | French | 223/69 |
| 2,841,315 | 7/1958 | Paris | 223/70 |
| 4,199,088 | 4/1980 | Sanko | 223/70 X |

*Primary Examiner*—Louis Rimrodt
*Attorney, Agent, or Firm*—Gifford, VanOphem, Sheridan & Sprinkle

[57] ABSTRACT

The invention relates to a pressing dummy for finish pressing sweaters, jackets and similar garments, primarily made of knit fabric, consisting of a hollow body for the body portion and two pivot arms for the sleeves of the sweater, the jacket or a similar garment, with the pivot arms being able to be pivoted independently of the hollow body on the base support of the dummy used for pressing about a vertical axis by means of a manual lever via linkages out of the operative position, in which they are located in a plane in a manner in which they are aligned with the hollow body, forwardly towards the operating personnel into a receiving position, in which the operating personnel can without difficulty pull the sleeves of the garment onto the pivot arms after the body portion of the garment have been drawn over the hollow body, whereupon the pivot arms can again be pivoted back into their operative position, in which the finish-pressing operation takes place, in which a hot air-steam-mixture is blown into the hollow dummy body and simultaneously into the sleeves of the garment by means of nozzles provided on the pivot arms. After finish-pressing, the garment still disposed on the dummy used for pressing is cooled by blowing ambient air therethrough, and the condensate formed in the dummy is eliminated with the aid of the stream of hot air blown through the dummy during removal of the garment from the dummy and dressing of the next garment on the dummy.

11 Claims, 2 Drawing Figures

20°
4a
4
15
15a

A
2
2

APPARATUS AND METHOD FOR USE IN FINISH PRESSING

FIELD OF THE INVENTION

The invention relates to a dummy for use in finish pressing sweaters, jackets and similar articles of clothing, primarily of knit fabrics, consisting of a hollow dummy body for the trunk portion and two pivot arms for the sleeves of the sweater, the jacket or similar article of clothing. Furthermore, the invention relates to a method of finish pressing with the aid of dummies to be used in pressing.

DESCRIPTION OF THE PRIOR ART

The conventional pressing dummies have pivot arms, in which the main body is a simple wire form, the pivot arms are hinged thereto so as to be pivotal upwardly, so that a sweater is first drawn with the trunk portion over the pivot arms after they have been pivoted upwards and then the sleeves of the sweater are drawn onto the pivot arms while the sweater rump is drawn onto the hollow body. This type of dressing and removing respectively of sweaters and, very generally, pieces of garment that are finish pressed on pressing dummies is not only cumbersome for the operating personnel on account of the substantial height level of the work but, rather, also is rather time-consuming.

SUMMARY OF THE PRESENT INVENTION

It is, therefore, the object of the invention to design a pressing dummy of the type as mentioned in a manner such that it is possible at a comfortable operating level to quickly put on and take off the sweaters, jackets and similar pieces of clothing. Furthermore, a method is to be developed for finish pressing, which overcomes the drawbacks encountered in finish pressing the said pieces of clothing on dummies used in pressing, which drawbacks particularly concern the condensing of the steam still present in the pressing dummy when cooling takes place by means of cooling air.

This object in regard to the dummy used in pressing is solved according to the invention in that the pivot arms are mounted so as to be pivotal about a perpendicular axis on the base support of the pressing dummy independently of the hollow dummy body.

This type of mounting makes it possible to swivel the pivot arms out of the operative position, in which they are in alignment with the hollow body, forwardly towards the operating personnel into the receiving station. Hence, the pivot arms in this position do not extend upwardly beyond the hollow dummy body but, rather, are pivoted forwardly towards the operating personnel, so that a comfortable working level is provided for.

On account of the fact that the pivot arms are in the receiving position directed towards the operating personnel, it is possible to comfortably slide the sleeves of the sweater or other piece of garment over the pivot arms after the trunk portion of the sweater has been dressed, whereupon the pivot arms are returned again into the operative position.

According to an embodiment of the invention, the pivot arms may include a carrying rod to further facilitate dressing the piece of clothing to be pressed on the pivot arms and removing it therefrom, to which rod an air-pervious profile metal sheet is articulated in a manner such that upon pivoting the pivot arms into the receiving position the metal profile sheet is moved for example by means of a cable towards the carrying rod. In that way the sleeves of the sweater or piece, respectively; of clothing can very easily, with the pivot arms having been pivoted forwardly, be slid over the latter ones.

Nozzles are arranged between the carrying rods and the air-pervious metal profile sheets of the pivot arms, out of the apertures of which nozzles the hot-air-steam mixture emerges for finish pressing the sweater or the like. According to another advantageous embodiment of the invention it is possible to adjust these hot-air-steam mixture exit apertures of the nozzles with respect to the pivot arm length or respectively with respect to the length of the sweater sleeve slid over the pivot arms in order to avoid any adverse effect by the pressing forces on the elasticity of the sleeve ends of the sweaters which are provided with elastic ribbed cuffs that may consist of pure acryl or acrylic mixtures with other fibres. It is possible in that way to avoid contact of the air-steam-mixture emerging from the nozzles with the bottom sleeve ends having the elastic ribbed cuffs that are sensitive to steam because in this case the nozzle apertures, viewed in longitudinal arm direction, are located above that elastic cuff.

The sub claims characterize further advantageous embodiments of the invention.

In the case of the process according to the invention the hot air is, upon finish pressing by means of a hot-air-steam-mixture, passed continuously through the pressing dummy and steam is blown-in additionally only during the pressing process as the finish pressed garment is removed from the pressing dummy and the next garment is pulled onto the pressing dummy in order to avoid the formation of condensate in the dummy used for pressing when finish pressing sweaters, jackets and similar pieces of clothing which are primarily made of knit fabric.

The steam proportion of the mixture should amount to from 10 to 70% in order to maintain the formation of condensate in the dummy as low as possible. It has also proven to be advantageous to adjust the supply of hot air and steam in a manner such that the respective amounts thereof are independent of one another.

DESCRIPTION OF THE DRAWINGS

The invention will be explained in greater detail below reverting to the embodiments shown in the drawing. The drawing shows in.

DESCRIPTION OF A PREFERRED EMBODIMENT OF THE PRESENT INVENTION

Figure 2:
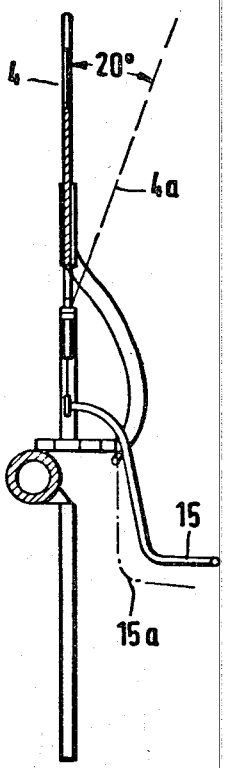
FIG. 2 a side view of the dummy used for pressing as shown in FIG. 1.

The hollow body 1 of the dummy used in pressing the trunk portion of the sweater or other article of clothing is arranged on a base support 2. Pivot arms 3 and 4 for the sleeves of the sweater include carrying rods 5, 6 that extend obliquely towards the hollow body 1, the rods being mounted with their lower bent ends on either side of the hollow body 1 in vertically arranged sleeves 7, 8 and being adapted to be slightly pivoted forwardly, i.e. out of the plane of the drawing by about 20° towards the operating personnel.

Figure 1:
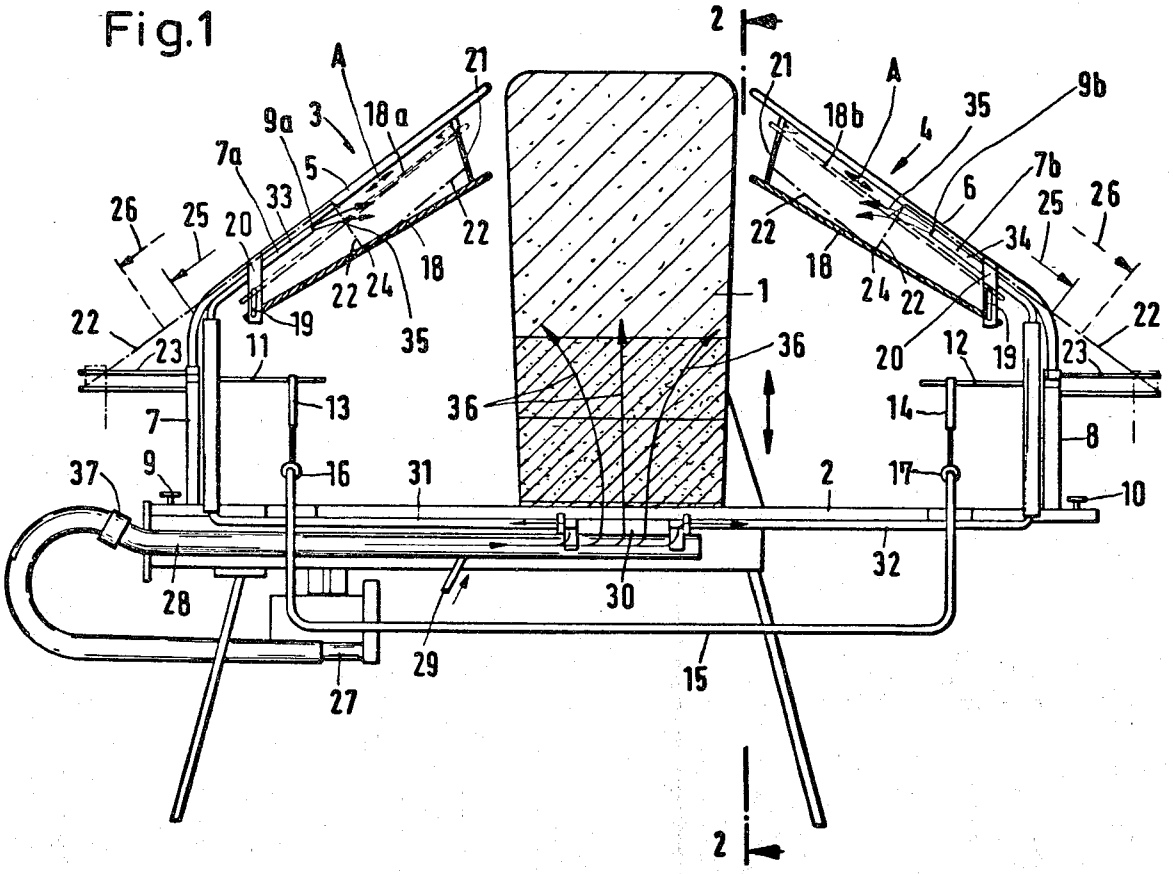
FIG. 1 a diagrammatic front view of the dummy used for pressing.

The sleeves 7, 8 are arranged to be adjustable on the base support 2, such as is shown diagrammatically by the set screws 9, 10 in FIG. 1, so that they can be fixedly arranged closer to or farther away from the hollow body 1. Levers 11, 12 directed towards the hollow body 1 are mounted on the carrying rods 5, 6 above the sleeves 7,8, which levers are engaged by forks 13, 14 which are disposed on the end of an U-shaped manual lever 15. That lever is hingedly mounted at 16 and 17, so that when the manual lever 15 is swivelled towards the hollow body 1 the pivot arms 3, 4 are pivoted forwardly, i.e. thus towards the operating personnel, such as is diagrammatically shown at 4*a* and 15*a* in FIG. 2.

An air-pervious metal profile sheet 18 is mounted on each carrying rod 5, 6 in a manner such that it is adapted to be moved towards the carrying rod 5, 6 such as may be seen from the dotted representation at 18*a* and 18*b*. To that end, the lower end of the metal profile sheet 18 is guided in a slot 19 of an arm 20 attached to the carrying rod 5, 6, while the upper end is articulated to the carrying rod 5, 6 by means of a double lever 21. A cable line 22 is attached at one end to a further lever 23, which is attached to the carrying rod 5,6 above the sleeves 7,8 opposite to the level 11, 12. The cable line 22 is inserted into the hollow carrying rod 5,6 and extends therethrough in a manner so as to be deflected approximately rectangulary relative to a pipe elbow 24 on the metal profile sheet 18 and from there extends further to the lower arm of the double lever 21.

If the manual lever 15 is urged towards the hollow body 1, such as shown at 15*a* in FIG. 2, the lever 23 swivels out correspondingly and, as shown by the arrows 25 and 26 in FIG. 1, the metal profile sheet 18 is moved via the cable line 22 towards the carrying rod 5, 6.

A blower 27 is attached to the base support 2, which blower supplies hot air through line 28 to the pressing dummy via a temperature-controlled heating element, with steam for the pressing process being blown through a nozzle 29 merging into the line 28. A broad jet nozzle 30 is provided for supplying the hot air-steam-mixture to the hollow body 1, which nozzle blows the hot air-steam-mixture into the hollow body as shown by the arrows 36, while the hot air-steam-mixture simultaneously flows through lines 31, 32 to the pivot arms 3, 4 and enters into the nozzles 7*a*, 7*b* connected with the latter, out of which nozzles it emerges through the nozzles apertures 9*a*, 9*b*, as shown by the arrows 35.

The nozzles 7*a*, 7*b* are adjustable in the axial direction of the pivot arms, i.e., in the direction of the arrows A so that the nozzle apertures 9*a*, 9*b* can be slid into the pivot arms at least to an extent such that the hot air-steam-mixtures emerging therefrom does not contact the steam-sensitive regions of the product to be pressed, such as for example the elastic ribbed cuffs at the sleeve ends of the sweaters, so that the latter do not require any cover to protect them from the steam emerging from the nozzle. The nozzles 7*a*, 7*b* may also consist of pipe elements 33, 34, which are designed to be slid within one another or out of one another for extension or, respectively, reduction in length.

The mode of operation with the aid of the pressing dummy when finish pressing sweaters, jackets and similar pieces of clothing is as follows. In order to dress the sweater on the pressing dummy the pivot arms 3, 4 are caused to take the forwardly pivoted position 4*a* shown in dotted lines by pushing lever 15 forwardly, as shown at 15*a* in FIG. 2. Then the body portion of the sweater, i.e., the chest and back portion thereof, are at first pulled over the hollow body 1 and there-upon the sleeves of the sweater are slid over the pivot arms 3, 4 with the ribbed cuffs located at the sleeve ends first. This can be done very easily and without over-extending the ribbed cuffs because the metal profile sheet 18 of the pivot arms 3, 4 for this purpose takes the position 18*a*, 18*b* shown in dotted lines. After the sweater has been pulled onto the pressing dummy the pivot arms 3, 4 are returned into the operative position by means of the manual lever 15, i.e., are moved from the position shown at 4*a* in FIG. 2 into the vertical position. In that way the metal profile sheet 18 of the pivot arms 3, 4 falls down under the effect of gravity out of position 18*a*, 18*b* and into the normal position, which is shown in drawn line in FIG. 1.

The return movement of the metal profile sheet 18 can be enhanced by weights or, respectively springs. A linkage could also be utilized instead of the cable line 22, and it is of course also possible to use a pneumatic, hydraulic or electromagnetic or, respectively, electrically operating control instead of manual actuation. The manual lever 15 could also be replaced by a corresponding control means.

As already stated above, hot air is supplied through the line 28 when finish pressing the garment dressed on the pressing dummy. The hot air being adjustable as to amount and having a temperature of about 120° and thereabove and, as indicated by the arrows 36 in FIG. 1, entering into the hollow body 1 of the pressing dummy and simultaneously entering the sleeves of the garment to be pressed out of the nozzle apertures 9*a*, 9*b* via line 31 and 32, as indicated by the arrows 35.

Steam is for the pressing process blown into the hot air through nozzle 29 in the conduit 28. The amount of steam is adjustable depending upon the fabric or, respectively, type of fibre to be treated, the adjustment being made for example by means of a valve or slide member not shown.

As the pressing dummy is operated, the hot air continuously streams through the dummy, i.e., emerges at the dummy surface and passes through the fabric. To be pressed and located on the dummy surface, the fabric primarily being knit fabric, while the steam is blown-in only for the pressing process itself. The pressing process is followed by the usual cooling phase, in which ambient air is, through a vacuum system in use in many textile plants, blown or aspirated through the pressing dummy for cooling. This supply of hot air to the pressing dummy is not interruppted as the finish pressed garment is removed from the pressing dummy and the next garment is pulled onto the pressing dummy, with condensate formed during the cooling phase thus being eliminated in that it vaporizes on account of the stream of hot air and escapes together with the air out of the pressing dummy. The proportion of steam in the hot air-steam-mixture used for pressing amounts to between 10 and 70%. During the cooling phase the continuously flowing hot air is not conducted into the pressing dummy but, rather, is conducted into the cooling air suction channel at the exit end of the dummy in the event the supply of hot air is not completely cut off during the short cooling period.

I claim:

1. In combination with a dummy for use in finish pressing sweaters, jackets and similar garments, primarily made of knit fabric, consisting of a hollow body for the body portion and two pivot arms for the sleeves of the garment, which arms are pivotally mounted independently of the hollow body on the base support of the dummy, the improvement comprising first means for pivotally securing each of the pivot arms about a substantially perpendicular axis, and wherein the arms comprise a carrying rod, an air-pervious metal profile sheet and second means for hingedly mounting said profile sheet to said carrying rod so that the metal profile sheet is moved towards the carrying rod as said arms pivot about said perpendicular axis toward a first position.

2. A dummy according to claim 1, wherein said second means comprises a cable.

3. A dummy used for pressing according to claim 1, characterized in that in said first position, the two pivot arms are pivoted forwardly towards the operating personnel into a receiving position, from an operative position in which they are in alignment with the hollow body, and wherein said first means comprises a manual lever means for pivoting said arms.

4. A dummy used for pressing according to claim 1 characterized in that the pivot angle from the operative position to the receiving position amounts to about 20°.

5. A dummy used for pressing according to claim 1, and further comprising nozzles located between the carrying rods and the air-pervious metal profile sheets of the pivot arms, and means for supplying hot air-steam-mixture to the nozzles, wherein the nozzles include exit openings and means for adjustably displacing said exit openings with respect to the sleeve length of the dressed sweater or the like.

6. A dummy used for pressing according to claim 5, characterized in that the nozzles are pipe elements displaceable in longitudinal direction of the sleeves of the sweater or the like.

7. A dummy used for pressing according to claim 5, characterized in that the carrying rods consist of air-pervious metal profile sheets.

8. A process for finish pressing sweaters, jackets and similar garments primarily made of knit fabric, on dummies used for pressing, characterized in that finish pressing comprises supplying a hot air-steam-mixture in a manner to avoid the formation of condensate, wherein said hot air only is passed continuously through the pressing dummy during removal of the finish-pressed sweater, jackets and similar garments from the pressing dummy and during dressing of the next garment on the pressing dummy in order to eliminate condensate that has formed, and in that steam is additionally blown-in only during the pressing operation.

9. A process according to claim 8, characterized in that the steam proportion of the mixture amounts to from 10 to 70%.

10. A process according to claim 8, characterized in that the supply of hot air and the supply of steam are adjusted as to amounts independently of one another.

11. A dummy for use in finish pressing sweaters, jackets and similar garments, primarily made of knit fabric, consisting of a hollow body for the body portion and two pivot arms for the sleeves of the garment, characterized in that the pivot arms are mounted to be pivotal about a perpendicular axis independently of the hollow body on the base support of the dummy used for pressing, and wherein each pivot arm comprises a carrying rod and an air-pervious metal profile sheet, further comprising nozzles located between the carrying rods and the air-pervious metal profile sheets of the pivot arms, and means for supplying hot air-steam-mixture to the nozzles, wherein the nozzles include exit openings and means for adjustably displacing said exit openings with respect to the sleeve length of the dressed sweater or the like.

* * * * *